US005121089A

United States Patent [19]

Larson

[11] Patent Number: 5,121,089

[45] Date of Patent: Jun. 9, 1992

[54] MICRO-MACHINED SWITCH AND METHOD OF FABRICATION

[75] Inventor: Lawrence E. Larson, Santa Monica, Calif.

[73] Assignee: Hughes Aircraft Company, Los Angeles, Calif.

[21] Appl. No.: 608,139

[22] Filed: Nov. 1, 1990

[51] Int. Cl.[5] ..... H01P 1/10

[52] U.S. Cl. ..... 333/107; 333/262; 200/181

[58] Field of Search ..... 333/101, 104–106, 333/246, 262; 200/181, 504

[56] References Cited

U.S. PATENT DOCUMENTS

| | | | |
|---|---|---|---|
| 2,773,242 | 12/1956 | Grieg | 333/105 |
| 3,165,712 | 1/1965 | Gordon | 333/106 X |
| 4,065,677 | 12/1977 | Micheron et al. | 200/181 X |
| 4,070,752 | 1/1978 | Robinson . | |
| 4,654,676 | 3/1987 | Itano et al. . | |
| 4,740,410 | 4/1988 | Muller et al. . | |
| 4,754,185 | 6/1988 | Gabriel et al. . | |
| 4,789,803 | 12/1988 | Jacobsen et al. . | |
| 4,887,248 | 12/1989 | Griebeler . | |
| 4,922,253 | 5/1990 | Nathanson et al. | 333/105 X |

OTHER PUBLICATIONS

"Passive Devices", Inder Bahl, et al., Microwave Solid State Circuit Design, pp. 373–422.

"Design Considerations for Micromachined Electric Actuators", S. F. Bart, et al., Sensors and Actuators, 14 (1988) pp. 269–292.

"IC-Processed Electrostatic Micro-motors", Long--Sheng Fan, et al., 1988 IEEE, pp. 666–669.

*Primary Examiner*—Paul Gensler

*Attorney, Agent, or Firm*—E. E. Leitereg; P. M. Coble; W. K. Denson-Low

[57] ABSTRACT

A miniature electrostatically actuated switch and process for fabricating it in which the switch is operable to connect and disconnect one or more transmission lines laid down on a dielectric substrate of an integrated circuit wafer. The switch is fabricated on the integrated circuit wafer using integrated circuit fabrication processes including thin films of conductive materials and photoresist and selective removal of these films. the switch includes a rotating switch blade which rotates about a hub formed on the dielectric substrate under the influence of electrostatic fields created by control pads and other switch elements formed on the dielectric substrate, whereupon a microwave signal can be switchably transmitted along the transmission line formed on the substrate.

23 Claims, 3 Drawing Sheets

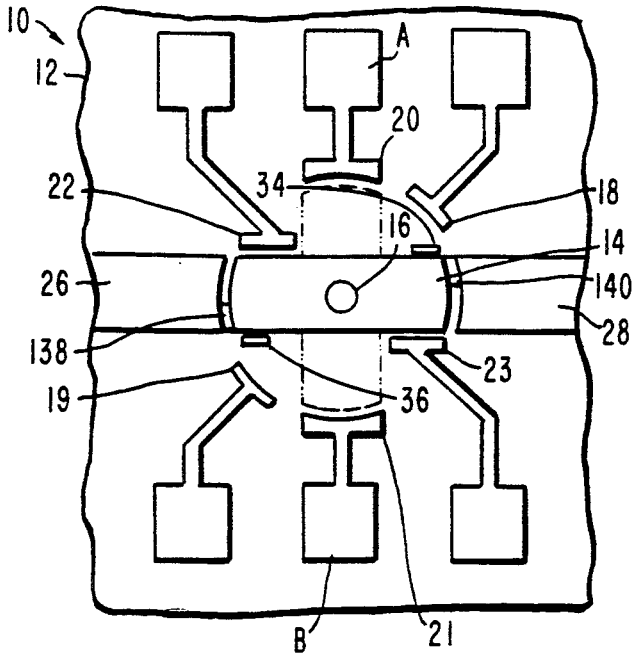
Fig. 1.
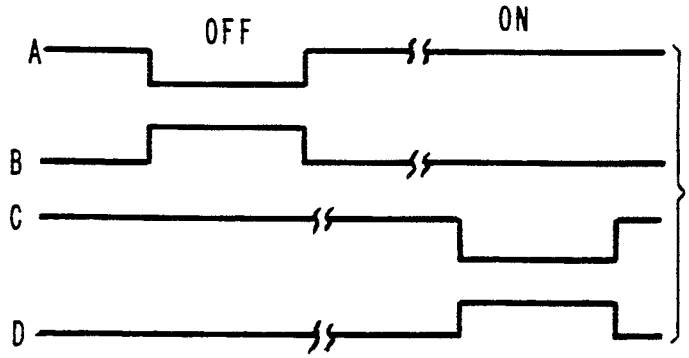
Fig. 2.
Fig. 3a.
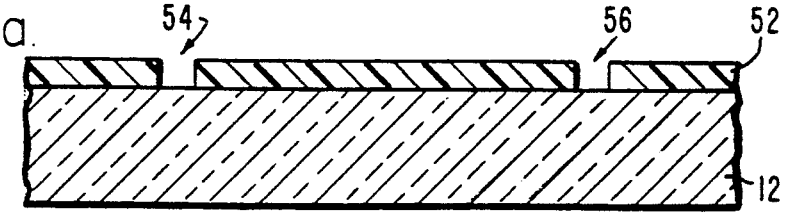
Fig. 3b.
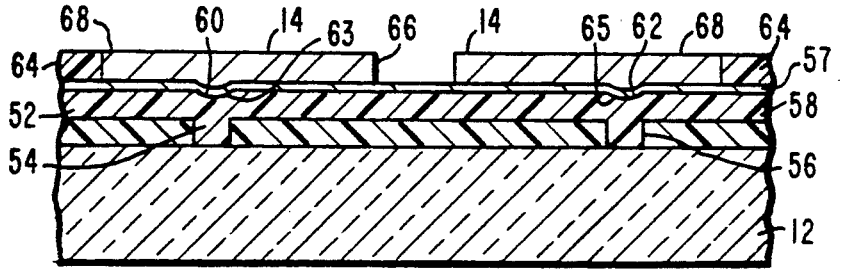

MICRO-MACHINED SWITCH AND METHOD OF FABRICATION

BACKGROUND OF THE INVENTION

1. Field of the Invention

This invention relates generally to electrical switches, and more particularly to micro-machined, electrostatically actuated switches of a type that can be fabricated on integrated circuit substrates using integrated circuit processing technology.

2. Description of the Related Art

With high density integrated circuits, power, size and space constraints are of primary importance. For example, because of their size, semiconductor switches have been fabricated on dielectric substrates of integrated circuit wafers. Since semiconductor switches have electrical resistance, they create a power loss in the switched signal which, with very low energy levels signals, can create a significant challenge to the circuit designers. For example, raising the power level of the signal can apply an additional heat loading to the circuit and must be removed.

Alternatively, electro-mechanical switches do have a low resistance, and thus, do not create a significant power loss in the switched signal. However, to date such switches have typically been quite large relative to the size of integrated circuit chips. For example, many of the switches can be the same size as the chip or even larger. Moreover, because of their size, the switches were typically located off of the chip surface. Thus, there has been a significant increase in the space requirements for the circuitry, resulting in a reduction in the overall circuit density. Furthermore, these electro-mechanical switches have their own relatively significant power requirements.

In addition, for microwave, millimeter wave and high data rate signal processing, the distances that the transmitted signal has to travel from the integrated circuit chip to the off wafer switch and back to the chip can result in a significant time delay in the signal that must be accounted for by the circuit designer.

With the advent of micro-machining, it has been shown that it is feasible to fabricate mechanical and electro-mechanical devices using thin film integrated circuit technology. Some specific examples are the levers, gears, sliders, and springs referred to in U.S. Pat. No. 4,740,410, issued on Apr. 26, 1988, to R. S. Muller, et al, and entitled Micro Mechanical Elements and Methods for their Fabrication. In addition, electro-mechanical devices such as rotatable motors and linear motors have been shown in U.S. Pat. No. 4,754,185, issued on Jun. 28, 1988 to K. J. Gabriel et al, and entitled Micro-Electrostatic Motor.

SUMMARY OF THE INVENTION

In meeting the challenges mentioned above, the present invention is embodied in a micro-machined, electrostatically actuated mechanical switch fabricated on a dielectric substrate of an integrated circuit chip using integrated circuit processing techniques. Specifically, a hub and a switch blade are fabricated on the substrate using integrated circuit processing technology. This results in a switch blade that can be rotated about the hub under the influence of electrostatic forces produced by control members also formed on the substrate. Thus, the switch blade can be rotated to open and close a gap across a transmission line, also formed on the chip, so that a transmitted signal can be selectively switched ON and OFF by the micro-miniature switch. It is also possible to fabricate multiple throw switches which selectively switch and distributes signals from a number of transmission lines formed on the substrate.

The process for fabricating such switches includes laying down layers of photoresist and layers of electrically conductive and dielectric material on the substrate with lithographic formation of patterns for the switch elements and selective removal of the photoresist and conductive and dielectric materials to form such switch elements.

There are numerous advantages to this switch and process. Among them are that micro-miniature switches can be batch fabricated on a chip substrate utilizing the same processing techniques that the integrated circuits are fabricated with. Thus at the same time integrated circuits are being fabricated, switches can be fabricated that take up very little space and are easily replicated. Moreover, certain embodiments of the switch are capable of switching signals within a frequency range from d.c. through microwave and millimeter wave. Others are bandwidth selective to filter out DC and lower frequency signals. The switch also presents an excellent impedance match to the transmission line when the switch is in the closed position. Consequently, the switch can be especially useful for microwave and millimeter wave signal switching applications. In addition, the micro-machined switch is radiation hardened.

Additional advantages are that the switch exhibits very little electrical resistance and low insertion loss in the ON position, thus creating very little power loss over the bandwidths of interest. Also, the switch exhibits high electrical isolation over the bandwidth of interest. Moreover, the switch does not add significantly to the distance that a transmitted signal must travel to be switched. Furthermore, the switch itself requires very little electrical power to rotate the switch blade between the ON and OFF positions and to hold the switch blade in those positions. As a result the additional electrical power requirement of the switch is quite low.

BRIEF DESCRIPTION OF THE DRAWINGS

FIG. 1 is a top plan view of a preferred embodiment of a micro-machined rotatable switch with the switch blade in an ON position;

FIG. 2 is a waveform diagram of control signals applied to control elements of the switch of FIG. 1 to rotate the switch blade between an ON position and an OFF position;

FIGS. 3*a* through 3*d* are cross sectional side elevation views showing processing steps for fabricating the switch of FIG. 1;

DESCRIPTION OF THE PREFERRED EMBODIMENTS

Figure 3C:
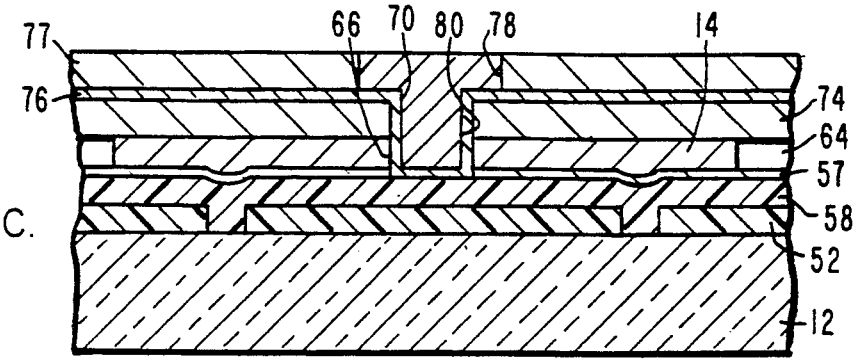

Referring now to the drawings in more detail, as illustrated in the top plan view of FIG. 1, a micromachined switch 10 is fabricated on a substrate 12. The substrate 12 is preferably composed of gallium-arsenide since it is an excellent dielectric and semiconductor devices can be fabricated on it as well as transmission lines. It is believed that other materials such as, for example, silicon, sapphire, or indium phosphide, could be used for substrate 12.

As will be explained subsequently in more detail with reference to FIGS. 3*a* through 3*d*, a switch blade 14 is fabricated over the substrate 12 and a hub 16 is formed and attached to the substrate using integrated circuit processing techniques. Also fabricated on the surface of substrate 12 is a transmission line having an input segment 26 and an output segment 28. The switch blade 14 is of a generally elongate rectilinear configuration, and is rotatably mounted on the hub 16 so that the switch blade 14 rotates in a plane parallel to the plane of the top surface of substrate 12. The ends of switch blade 14 are preferably the same width and area as those of the input segment 26 and output segment 28 so that their characteristic impedances are substantially identical. Moreover, the ends of blade 14 and transmission line segments 26 and 28 are configured in arcs that are concentric to the axis of hub 16. The blade 14 is electrically conductive and has been made of materials such as thin film layers of titanium and gold. As is conventional with strip lines in microwave integrated circuit technology a ground plane (not shown) can be included to enable the switch to operate more effectively at higher frequencies. Such ground planes are described in the book Microstrip Lines and Slotlines, by K. C. Gupta, Ramesh Garg, and I. J. Bahl, published by ARTECH HOUSE, INC. Dedham, Mass., Copyright 1979.

Switch blades 14 have been fabricated that are very small and can easily fit on an integrated circuit chip. For example, switch blades may typically be 1000 microns long, 100 microns wide and 2 microns thick.

The transmission line segments, 26–28, are diametrically opposite one another along radial line extending through the axis of hub 16 and can also be fabricated of gold, preferably by electro plating. Each arcuate end of the transmission line segments 26 and 28 is equidistant from the hub 16. Thus when the switch blade 14 is rotated into the ON position as illustrated in FIG. 1, the arcuate ends of switch blades 14 provide a surface area that matches with the surfaces of the transmission line segments 26 and 28 in a spaced apart non-contacting relationship. The air gaps between the matching ends of the rotor 14 and the transmission line segments 26 and 28 should be as short as practical to lessen stored energy density drop. For example, the gap should be less than about 0.1 of the wave length of the highest frequency input signal on the input transmission line segment 26. It is believed that an air gap of between about 0.5 microns and about 5.0 microns wide would be practical. Substantially larger air gaps would greatly increase the stored energy drop. Typically the uniform air gap between the matching ends has been about 1 micron.

Pairs of control pads 18–19, 20–21 and 22–23 are also fabricated on the surface of substrate 12. Individual control pads of each pair 18–29, 20–21 and 22–23 are disposed generally diametrically opposite to one another each along a radial line extending through the axis of the hub 16 and angularly displaced from the locations of the ends of the transmission line segments 26 and 28. A material that has been used to fabricate these pads is gold, preferably by electroplating. As will be explained in more detail with reference to the switching signal wave form diagram of FIG. 2, electrical signals A and B are applied to the control pad pair 18–19, and then to control pad pair 20–21, respectively to generate an electro static field which effectively rotates the switch blade 14 between the ON or closed circuit position and OFF or open circuit position as shown in phantom line representation. When the switch blade 14 is rotated between the ON and the OFF positions there is a gap and thus electrical isolation between the switch blade 14 and control pads 18–19 and/or 20–21.

Further control of the rotation of switch blade 14 is afforded by two mechanical stop members, 34 and 36 fabricated on the surface of the substrate 12 which are of sufficient height to extend into the plane of rotation of blade 14. One wall of each stop member 34 and 36 is located along a line which is coextensive with the planes of opposite side walls of the transmission line segments 26 and 28 and are physically displaced from both the control pads 22 and 23 and the transmission line segments 26 and 28. These stop members are also made of gold and operate to prevent over rotation of the switch blade 14 beyond the closed position, and maintain the full surface area matching and characteristic impedance matching between the surfaces of the ends of the blade 14 and the ends of the transmission line segments 26 and 28. In addition, the stop members, 34 and 36 prevent the switch blade 14 from rotating into an inadvertent closed circuit position with the transmission line segments 26 and 28 if the switch blade 14 should rotate in a clockwise direction from the open position illustrated in FIG. 1. Since these stop members 34 and 36 are spaced from and thus electrically isolated from the transmission line segments, 26 and 28, no electrical contact can be made with the transmission lines by the switch blade 14 as a consequence of counter clockwise rotation of the switch blade.

When the blade 14 is in the closed position the small air gap between the surfaces of the ends of blade 14 and the ends of the line segments 26 and 28 only permits transmission of the higher frequency signals across the gap and any d.c. and lower frequency signals are blocked thus resulting in the switch acting as a high frequency band pass filter. Consequently, this switch 10 is especially useful for microwave and millimeter wave applications.

In order to switch the switch 10 between the ON position and the OFF position, control voltage signals A and B illustrated in FIG. 2 are selectively applied to the control pads 18 and 19, or to control pads 20 and 21 along leads connected to the control pads. The other control signal C and D is applied to the transmission line segments 26 and 28, respectively. Alternatively, the control voltage signals C and D could be applied to the pairs of control pads 22–23 positioned adjacent the ends of the transmission line segments 26 and 28 but electrically isolated therefrom.

Specifically, a control signal A of a first voltage polarity relative to a reference voltage level is applied to control pad 18 and a control signal B of an opposite polarity relative to the reference level is applied to the control pad 19 to rotate the blade about 45° from its closed position. The control signals C and D each are at the same signal level which is referred to as a reference level between the first and second polarity levels. Then the control signals A and B are switched over to the control pads 20 and 21. This creates an electrostatic field which attracts the blade 14 so that it is rotated and held in the full OFF position illustrated by phantom line in FIG. 1.

When, however, the switch is to be rotated to its closed or ON position, as illustrated in FIG. 1, the electrical control signals A and B are sequentially applied to control pads 18 and 19 and then returned to the same reference level while the control C is changed to a first voltage polarity and control signal D is changed to an opposite polarity level. Consequently, the electrostatic field created by the control signals C and D rotatably attracts and holds the switch blade 14 to the closed or ON position illustrated.

However, when it is necessary to turn the switch 10 OFF the control signals C and D are again switched back to the same reference voltage level and the control signals A and B are applied to the control pads 18 and 19 and then to control pads 20 and 21. The electrostatic field created by the control pads effectively rotates the switch blade 14 back into the open position or OFF position illustrated in phantom line in FIG. 1. It should be understood that it is possible to effect rotation of the blade 14 with a single pair of the control pads 18 and 19 or control pads 20 and 21.

The process for fabricating the switch of FIG. 1 is illustrated in FIGS. 3*a*. through 3*d*. which are not drawn to scale. As illustrated in FIG. 3*a*. the substrate 12 has a substantially planar surface upon which is deposited a first layer of photoresist 52 about 1.5 microns thick. A pattern of spaced apart apertures 54 and 56 are formed through the photoresist 52 to the surface of the substrate 12 preferably by means of photolithography and selectively removing the photoresist at the aperture pattern with a developer.

Next as illustrated in FIG. 3*b*., a second layer of photoresist 58 about 1.0 microns thick is deposited over the first layer 52. Small depressions 60 and 62 are formed in the exposed upper surface of this second layer of photoresist 58 in registration with the apertures 54 and 56. A thin layer 57 of titanium about 500 angstroms thick and gold about 4500 angstroms thick are deposited on the exposed surface of the second layer of photoresist 58. This is accomplished by evaporation of the titanium and gold. Small generally conical projections 63 and 65 are thus formed in the layer 57 at the depressions.

The switch blade 14 is formed by applying a third layer of photoresist 64 on top of the layer 58 and using photolithography to form a pattern corresponding the configuration of the rotor 14. The exposed rotor pattern area is then removed with a developer.

Next the switch blade 14 is fabricated with a thin film 68 of gold deposited on top of the thin layers 57 of titanium and gold. This layer of gold is approximately 2 microns thick, and is preferably deposited by electro plating. A cylindrical bearing 66 is formed through the center of the rotor 14—at a location in the pattern on photoresist 64 where the photoresist has not been exposed and removed—with the bearing axis perpendicular to the plane of the surface of the substrate. At this point, the photo resist layer 64 is selectively removed with a developer, and the exposed portion of the thin layer of metal 57 is selectively removed by ion milling.

As illustrated in FIG. 3*c*. the hub 16 is fabricated by applying another layer of photoresist 74 about 1.5 microns thick on top of the rotor 14. Then by photo lithography and selectively removing the layers of photoresist 74, 58, and 52 with a developer, a cylindrical aperture 70, extending down to the surface of substrate 12, is created having a diameter slightly less than the diameter of bearing 66 and an axis which is normal to the surface of the substrate.

At this time a layer 76 of titanium approximately 500 angstroms thick and gold approximately 4500 angstroms thick is deposited across the exposed surface of photoresist layer 74 and lines the walls of the aperture 70. The titanium adheres very well to the exposed gallium-arsenide of the substrate 12 at the bottom of aperture 70.

Again by photo lithography a cylindrical pattern for a cap 78 is formed in a 1.5 to 2.0 micron thick layer of deposited photoresist 77, and the exposed photoresist over the aperture 70 is removed with a developer. At this stage, the cap pattern cavity and aperture 70 is now filled with a layer of gold deposited by plating. As a result the hub 16 with a cap 78 and journal 80 are formed. The cap has a larger diameter than both the journal 80 and the bearing 66 of the blade 14. The thin layer of titanium 72 bonds well to the gold and provides a durable smooth surface which reduces wear and friction.

Figure 3D:
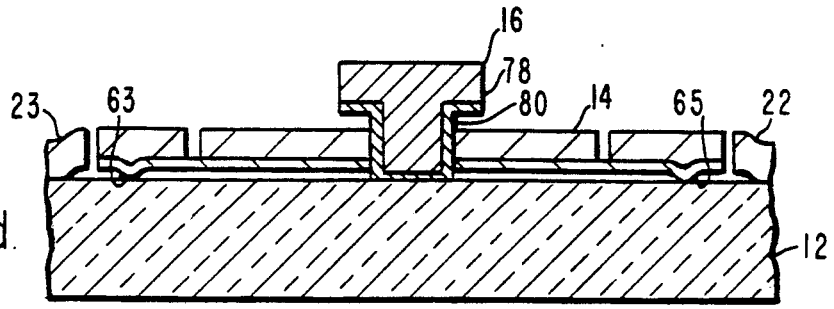

The switch 10 is now finally fabricated by dissolving all of the remaining layers of photoresist with a solvent and ion milling the exposed portions of the layer of titanium and gold to arrive at the switch 10 illustrated in cross section in FIG. 3*d*.

Functionally, the bearing 66 of switch blade 14 freely rotates about the journal 80 of hub 16 while the projections 63 and 65 on the lower surface of blade 14 ride on the surface of the substrate 12. The projections 63 and 65 space the rotor above the surface of substrate 12 thereby reducing the effects of electrostatic attraction between the rotor 14 and the substrate 12. Since the projections 63 and 65 have a small contact area with the substrate 12, they slide with low friction. The rotor 14 is prevented from coming off of the hub 16 by cap 78.

While fabrication of the control pads 18 through 23 and the transmission line segments 26 and 28 and stop members 34 and 36 (FIG. 1) were not included in the description pertaining to FIGS. 3*a*. through 3*d*., they are similarly fabricated during the processing of the rotor 14 and hub 16 using the same integrated circuit processing techniques described relative thereto.

Figure 4:
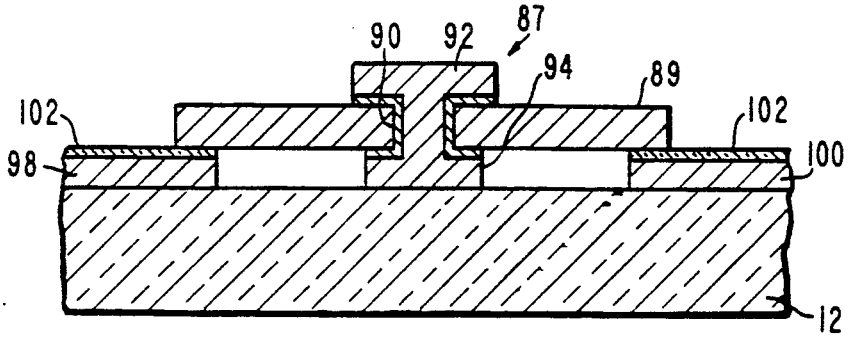
FIG. 4 is a cross section side elevation view of a second embodiment of a rotatable electrostatically actuated switch.

As illustrated in FIG. 4, another embodiment of a switch 87 can be fabricated in which the ends of the switch blade 89 rotate over the ends of the transmission line segments 98 and 100. In this embodiment the journal 90 of hub 92 has a lower boss portion 94 with a diameter larger than the diameter of the bearing in switch blade 89. The height of this lower boss portion 94 is about greater than the thickness of the transmission line segments 98 and 100, thus the switch blade 89 is rotated into and out of electrical communication with the transmission line segments 98 and 100 by means of the electrostatic field created by the control signals A and B applied to the control pads 18 through 21 (FIG. 1) and so that the ends of blade 89 overlap the ends of transmission line segments 98 and 100 by electrostatic attraction of the transmission line 98 and 100 created by the control signals C and D. A thin layer of dielectric 102 such as silicon dioxide about 1000 angrstoms thick is evaporated on top of transmission line segments 98 and 100 will prevent the blade 89 from contacting the transmission line segments. Accordingly, the switch blade 89 is held in intimate electrical communication with the transmission line segments 98 and 100 and the transmitted signal is conducted between transmission line segments 98 and 100. It should of course be understood that with precise micro-machining it is possible to fabricate the switch 87 so that a small gap or even no air gap exists between the surfaces of the switch blade 89 and the transmission line segments.

Figure 5:
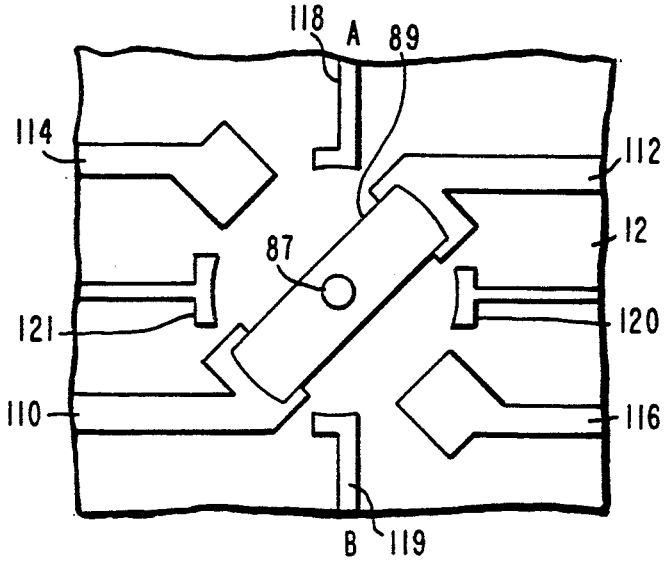
FIG. 5 is a top plan view of an embodiment of the micro-machined switch capable of switching between a plurality of microwave transmission lines to select and distribute a transmitted signal.

As illustrated in FIG. 5, a switch can be fabricated as a single pole multi-throw switch or a distributor in which a plurality of transmission line segments 110 and 112 or 114 and 116 can be rotatably connected to or disconnected from switch blade 89 by selectively applying control signals A and B to control pad pairs 118 and 119, or 120 and 121 and selectively applying control signals C and D to the transmission line segments 110 and 112 or 114 and 116.

Figure 6:
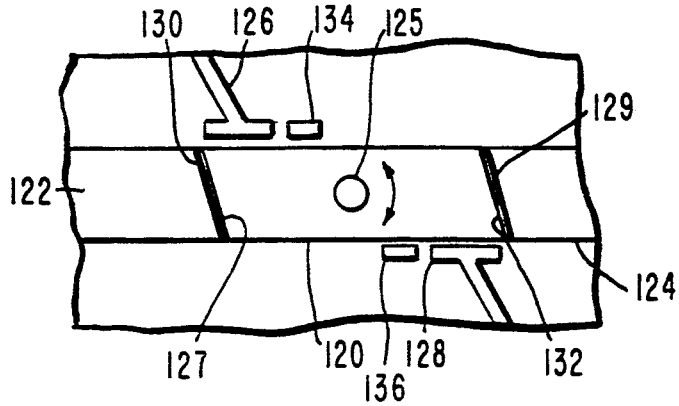
FIG. 6 is an embodiment of the switch in which the ends of the switch blade and the transmission line segments operable contact one another.

In another embodiment illustrated in FIG. 6, a switch blade 120 makes physical contact with the ends of transmission line segments 122 and 124 and is capable of also switching d.c. and lower frequency signals. The switch blade 120 and the transmission line segments 122 and 124 and control pads 126 and 128 of FIG. 6 are similar to the corresponding switch elements of the embodiment of FIG. 1 except that the ends of blade 120 and transmission line segments 122 and 124 are each configured at a bias such as a spiral relative to the axis of hub 125. The ends 127 and 129 of blade 120 are dimensioned such that they will make physical contact with the ends 130 and 132 respectively of the transmission line segments 122 and 124 when the switch is rotated into the closed position by the electrostatic field created when control signals C and D are applied to control pads 126 and 128. Stop members 134 and 136 stop over rotation of the switch blade 120.

Rather than a bias configuration on the contacting ends of the switch elements it would also be possible to make low friction physical contact with optional small electrically conducting projection 138 and 140 (FIG. 1) disposed on the face of ends of transmission line segments 26 and 28. These projections would have a surface area which is less than 50% of the surface area of the ends of transmission lines 26 and 28.

Figure 7:
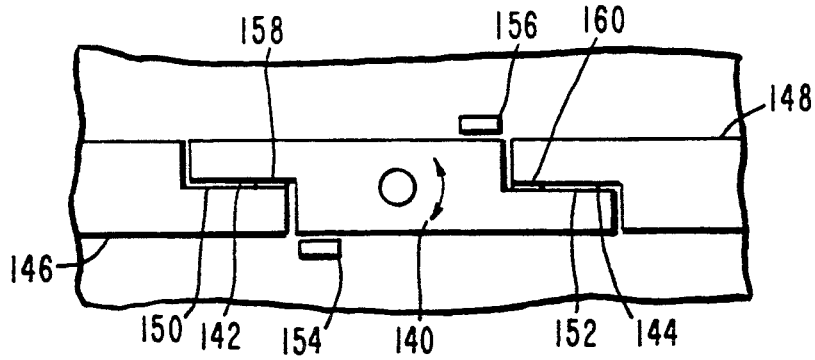
FIG. 7 is a top plan view of an embodiment of the switch in which the ends of the switch blade and the transmission line segments are configured for a predetermined frequency response.

In another embodiment of the switch illustrated in FIG. 7 each end of a switch blade 140 has a cutout section 142 and 144 of a predetermined length and depth. For example, and depending upon the desired frequency response, the cutout sections might be 100 microns long by 50 microns deep.

The transmission line segments 146 and 148 each include a cutout end section 150 and 152. These cutout sections 150 and 152 are configured and dimensioned to substantially the same configuration and dimensions as the cutout sections of the blade 140. Thus when the switch blade 140 is rotated into the closed position illustrated, stop members 154 and 156 stop rotation of the blade when the air gap between the blade 140 and the transmission line segments is about 1 micron.

Of course, as stated with regard to preceding embodiments, a small tab of electrically conductive material 158 and 160 could optionally be formed on the face of each cutout 150 and 152 respectively of the transmission line segments. Alternatively, the air gap could be eliminated and physical contact could be made along the adjacent faces of the matching cutouts. This contact between the switch blade 140 and the transmission line segments allows the switch to conduct d.c. and lower frequency signals.

Figure 8:
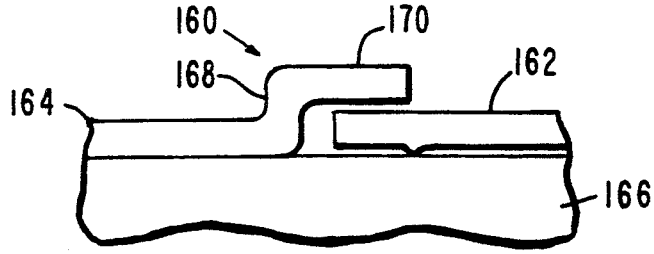
FIG. 8 is a cross sectional side elevation of an embodiment of a portion of the switch in which the control pads overlap the ends of the switch blade.

As illustrated in the cross sectional side elevation view of FIG. 8 a control member 160 overlaps the end of a switch blade 162. Specifically, the control member 160 includes a base 164 formed on a substrate 166, a body portion 168 extending from the base in a plane normal to the plane of the surface of the substrate, and a control pad 170 extending from the upper end of the body 168 in a plane parallel to the plane of the surface of substrate 166 and spaced therefrom.

When the switch blade 162 rotates into alignment with the control member 160, the end of switch blade 162 moves into the space between the substrate 166 and the control pad 170 to create an overlap between the ends of switch blade 162 and the control pad 170. In practice, this overlap might be 10 to 30 microns long and the air gap between the top of the switch blade 162 and control pad 170 might be 1 micron. An advantage of this overlap is that an efficient electrostatic attraction is created between the switch blade 162 and the control pad 170.

While salient features have been described with respect to particular embodiments, many variations and modifications can be made without departing from the scope of the invention. Accordingly, that scope is intended to be limited only by the scope of the appended claims.

What is claimed is:

1. An electrostatically actuated miniature switch comprising:

a substrate of dielectric material having a substantially planar surface;

a transmission line for conducting an electrical signal deposited on said surface, said transmission line including a first and a second segment each separated from the other by a gap;

a hub deposited on said surface;

a switch blade of electrically conductive material deposited above said surface and being operable to rotate about said hub, said switch blade being dimensioned to electrically close the circuit and operably conduct the electrical signal between said transmission line segments when said switch blade is rotated into a closed circuit position aligned between said transmission line segments and to electrically open the switch when said blade is rotated into a position out of alignment with said segments; and control means deposited on said surface and being operable to selectively receive control signals for producing an electrostatic field for operably rotating said switch blade between an open circuit position and a closed circuit position.

2. The miniature switch of claim 1 in which the ends of said switch blade and said transmission line segments are separated by an air gap.

3. The miniature switch of claim 1 in which the ends of said switch blade and the ends of said have a matching geometry and dimensions to operably form matching characteristic impedances between said switch blade and said transmission line.

4. The miniature switch of claim 2 in which the ends of said transmission line segments adjacent to the ends of said switch blade when in the closed circuit position include a projection portion which makes low friction contact with a portion of said switch blade.

5. The miniature electrostatically actuated switch of claim 1 in which said hub, said switch blade, and said control means are formed of thin films.

6. The miniature electrostatically actuated switch of claim 5 in which said transmission line, said hub, said switch blade, and said control pads are formed by evaporation and electroplating.

7. The miniature electrostatically actuated switch of claim 1 in which said control means further includes stop means positioned and displaced from said control pads to stop rotation of said switch blade beyond a predetermined position.

8. The miniature electrostatically actuated switch of claim 1 in which said switch blade has projections extending from the surface thereof which is adjacent to said surface of said substrate and being operable to ride thereon.

9. The miniature electrostatically actuated switch of claim 2 in which the ends of said transmission line segments and said switch blade have cutout segments which match with one another.

10. The miniature electrostatically actuated switch of claim 5 in which said hub has a cap which operably retains said switch blade on said hub.

11. The miniature electrostatically actuated switch of claim 5 in which said hub said, switch blade, and said control means are formed of titanium and gold.

12. The miniature electrostatically actuated switch of claim 1 in which said substrate is made of a material consisting of the group of gallium arsenide, silicon, indium phosphide, and sapphire.

13. The miniature electrostatically actuated switch of claim 5 in which said hub includes a journal having a boss with a diameter larger than the diameter of the bearing of said switch blade and one end being at a level which holds the contact surface of the switch blade planar with the contact surface of said transmission line segments.

14. The miniature electrostatically actuated switch of claim 1 in which said transmission line includes at least two pairs of first and second segments each pair being angularly displaced from said other pairs;

and said control means include at least two pairs of control pads whereby said switch blade is operable to open and close the circuit between pairs of said segments.

15. The miniature switch of claim 1 in which said control pads are positioned to be spaced from the ends of said switch blade when said switch blade is rotated into alignment with said control pads.

16. The miniature switch of claim 1 in which said control pads overlap the ends of said switch blade.

17. The miniature switch of claim 1 in which said control means includes at least three pairs of control pads, each pair being angularly displaced relative to the other pads to operably step said switch blade into and out of closed and open circuit positions in response to control signals.

18. The miniature switch of claim 1 in which the end of said switch blade and said transmission line sequents are curved to match with each other when said switch blade is in the closed position.

19. The miniature switch of claim 2 in which the air gap is not greater than about 0.1 of the wave length of the highest frequency signal to be transmitted on said transmission line.

20. The miniature switch of claim 2 in which the air gap is between about 0.5 microns and about 5.0 microns wide.

21. The miniature switch of claim 2 in which the air gap is less than about 5.0 microns wide.

22. The miniature switch of claim 2 in which the air gap is between about 0.5 microns and 3.0 microns wide.

23. A miniature electrostatically actuated switch comprising:

a substrate of dielectric material having a substantially planar surface;

a transmission line of electrically conductive material for conducting an electrical signal formed on said surface, said transmission line including a first and a second segment each separated from the other by a gap;

a hub deposited on and adhering to said surface between said first and second segments of said transmission line;

a switch blade of electrically conductive material formed over said surface and being operable to rotate about said hub, said switch blade being dimensioned to electrically close the circuit between said transmission line segments and conduct the electrical signal when rotated into a closed switch position; and control means including control pads formed on said surface at a location displaced from said transmission line segments and being operable to selectively receive control signals for producing an electrical field for operably rotating said switch blade between open circuit and closed circuit positions.

* * * * *